US006241388B1

(12) United States Patent
Terramani

(10) Patent No.: US 6,241,388 B1
(45) Date of Patent: Jun. 5, 2001

(54) PORTABLE BATH AND SHOWER CADDY

(76) Inventor: Maryann Terramani, 625 Serrill Dr., Hatboro, PA (US) 19040

( * ) Notice: Subject to any disclaimer, the term of this patent is extended or adjusted under 35 U.S.C. 154(b) by 0 days.

(21) Appl. No.: 09/354,953

(22) Filed: Jul. 16, 1999

(51) Int. Cl.[7] ..... A45C 11/00

(52) U.S. Cl. ..... 383/22; 206/581; 383/119; 446/75

(58) Field of Search ..... 150/113; 190/110; 206/77.1, 235, 372, 373, 443, 581, 823; 220/475, 483; 248/214, 215, 303, 311.2; 383/13, 22, 23, 33, 34, 34.1, 38–40, 119, 127; 446/75

(56) References Cited

U.S. PATENT DOCUMENTS

| | | | | |
|---|---|---|---|---|
| 1,844,872 | * | 2/1932 | Shipman | 383/33 |
| 2,717,717 | * | 9/1955 | Busch | 220/483 |
| 4,210,230 | * | 7/1980 | Weiner | 383/127 |
| 4,610,286 | * | 9/1986 | Cyr | 190/110 |
| 4,739,809 | * | 4/1988 | Adams | 206/823 |
| 4,889,141 | | 12/1989 | Lindsey | 132/286 |
| 5,007,531 | | 4/1991 | Lighten | 206/77.1 |
| 5,025,928 | * | 6/1991 | Orosy et al. | 206/581 |
| 5,148,926 | | 9/1992 | Cocuzzo et al. | 211/118 |
| 5,255,401 | * | 10/1993 | Sambrookes et al. | 206/77.1 |
| 5,299,683 | | 4/1994 | Poole | 206/77.1 |
| 5,423,611 | * | 6/1995 | Sherrard | 383/119 |
| 5,503,476 | * | 4/1996 | Hamdan | 383/38 |
| 5,553,719 | | 9/1996 | Campbell | 211/30 |
| 5,579,928 | * | 12/1996 | Anukwuem | 206/443 |
| 5,758,974 | * | 6/1998 | Markowitz | 383/119 |

* cited by examiner

*Primary Examiner*—Jim Foster
(74) *Attorney, Agent, or Firm*—Joseph W. Molasky Associates

(57) ABSTRACT

A device for holding toiletries and the like which comprises a container and means for suspending this assembly from an overhead support or from a wall. The device may be fabricated from any suitably stiff substance or from a flexible material as, for example, a pliant plastic which folds into a compact size and which, if desired, can be placed into a storage case for traveling purposes. When a flexible material is used, this device also includes within its sidewalls, a retractable stiffening means so as to impart, to the opened container, the support needed to ensure structural integrity. The device is waterproof and mildew-proof.

23 Claims, 8 Drawing Sheets

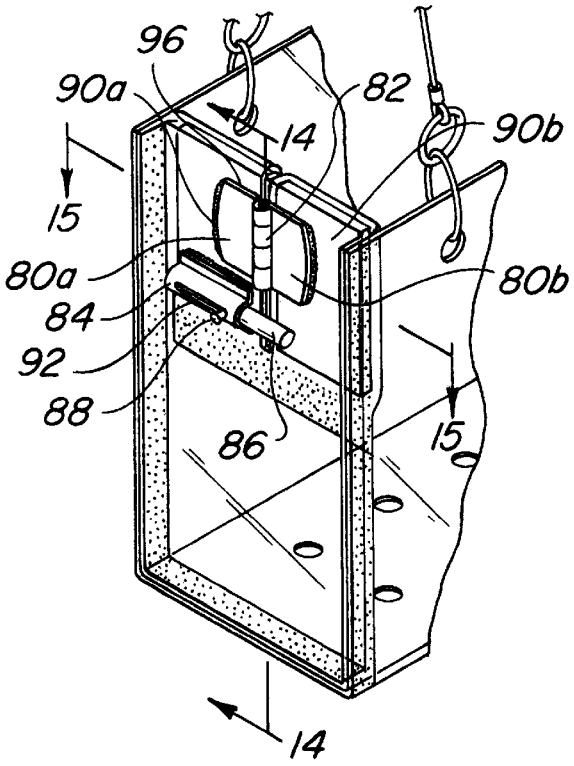
FIG. 13
FIG. 15
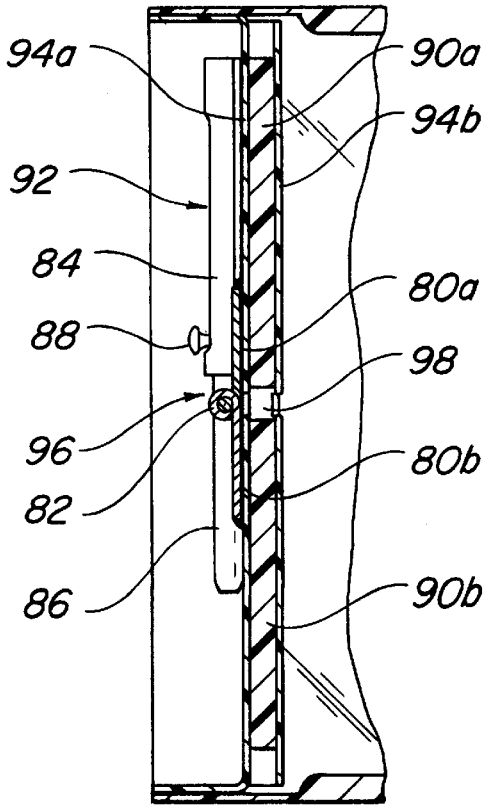
FIG. 14
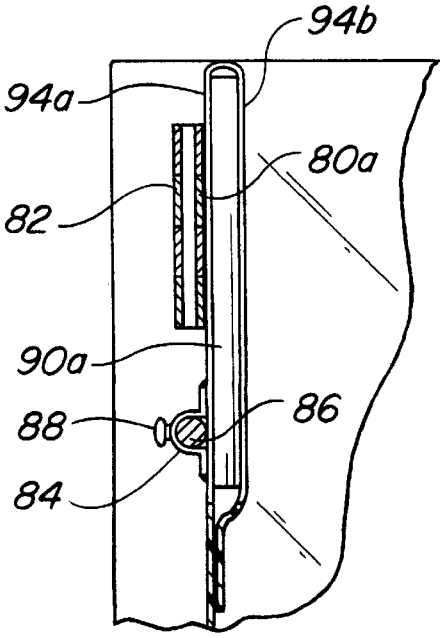

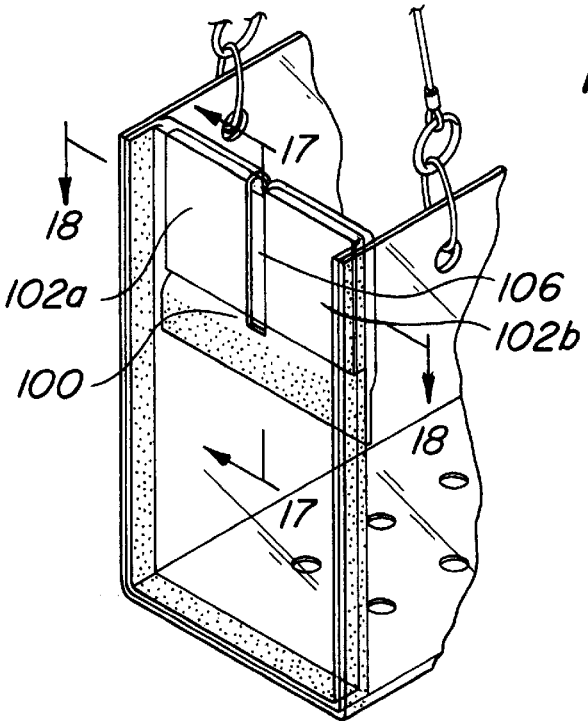
FIG. 16
FIG. 17
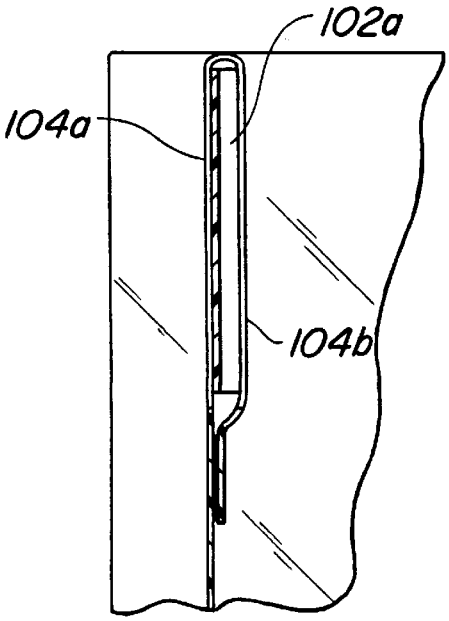
FIG. 18
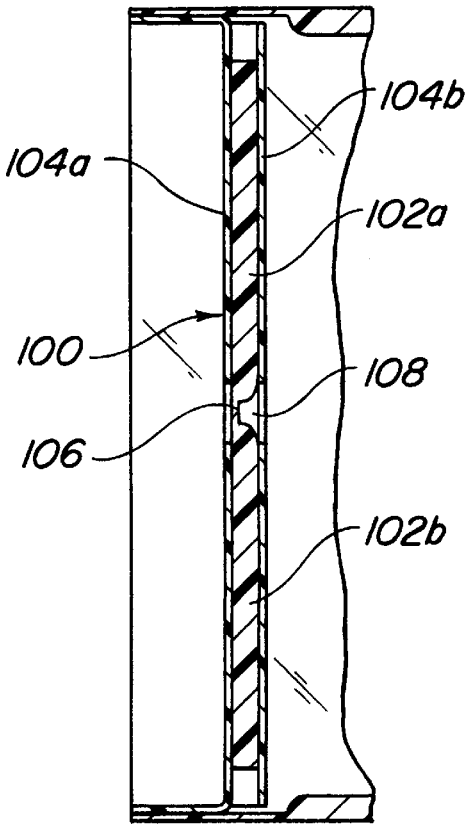

PORTABLE BATH AND SHOWER CADDY

BACKGROUND OF THE INVENTION

1. Field of the Invention

The present invention relates, in general, to a suspendable holder for articles. More specifically, the articles held by the holder may include toiletries. The holder also may be foldable and portable.

2. Description of the Prior Art

Holders for articles such as toiletries are well known in the art. Rigid plastic and wire shower caddies are examples of toiletry holders that are common place and well known. A recognized problem with these caddies is that they are not easily foldable or portable, and do not hold toiletries in their original containers.

U.S. Pat. No. 5,007,531, to Lighten, which is incorporated herein by reference, discloses a portable shower kit. It utilizes a pair of containers, each of which can be opened. In addition, the containers can be folded and attached to one another. The entire kit is adaptable for hanging. Similarly, U.S. Pat. No. 5,299,683, to Poole, which is incorporated herein by reference, discloses a hanging shower caddy that is in the form of an attaché case. When opened, various toiletry articles are removably displayed and arranged in fastened form for use by the user. Another hanging shower toiletries kit is disclosed by Lindsey, U.S. Pat. No. 4,889,141, which is incorporated herein by reference. The kit disclosed in Lindsey is a plastic soap dish onto which appendages have been added for holding toiletries such as a razor, a mirror, and several bottles. An aperture on the soap dish also provides means for holding a drinking cup.

Although the prior art patents as disclosed address the problem of transporting toiletries, none of the prior art patents enable the user to utilize soap, shampoo, lotion containers and the like in their original forms and sizes. Rather, the prior art patents require the user to transfer the toiletry item from the prepackaged container into the containers provided by the caddy. In addition, all of the prior art caddies are rigid and bulky. Moreover, the prior art patents do not disclose bath and shower caddies that are adaptable for holding unusual items associated with bathing, such as bath toys for use by children or by adults bathing children.

Therefore, a need remains for a portable article holder that is suspendable, lightweight, foldable, water resilient, mildew proof, capable of holding toiletries in their original containers, and adaptable for holding unusual bathing items.

SUMMARY OF THE INVENTION

This invention relates to a portable holder for articles comprised of a container having four sidewalls and a bottom panel which, in combination, define a cavity or container into which various articles may be placed. Each of the four sidewalls has a top portion, a bottom portion, a left side portion, and a right side portion. The portable holder also comprises a suspension means. The articles that may be held by the holder include bathing items, including toiletries and bath toys. The holder may be foldable and the bottom panel may contain perforations. In addition, the cavity contains a divider.

The holder may be made of any flexible or rigid material that will support the articles placed inside. In a preferred embodiment of the invention, the portable holder for articles contains sidewalls that are made of vinyl. Preferably, the vinyl is soft and clear. At least two of the four sidewalls are adapted to include or receive a stiffener in the form of a flat sheet-like panel. In one such example, two of the sidewalls contain fixed stiffeners, which are located at the top portion and bottom portion of each sidewall. The sidewalls containing fixed stiffeners are located opposite one another. In addition, two sidewalls may be adapted for retractable stiffeners. These sidewalls do not contain fixed stiffeners. The retractable stiffener is located at the top portion of the sidewall. The two sidewalls adapted for retractable stiffeners are located opposite one another.

Retractable stiffeners are stiffeners that can be manipulated in such a manner that they may provide stiffening in one instance and then be manipulated so that the amount of stiffening is reduced or withdrawn. The retractable stiffeners can reduce or withdraw the amount of stiffening by enabling the stiffener to be withdrawn, to be drawn back inward, pushed outward, to fold up, to shrink back, to rotate around a hinge, to rotate around a joint, to pivot, to fold, and the like.

Preferably, the retractable stiffener may be comprised of a hinge or of a removable stiffener. If the retractable stiffener is comprised of a hinge, the hinge enables the sidewall to be folded inward when the hinge is not engaged and to be opened in a stiff manner when the hinge is engaged. Alternatively, the hinge could be folded outward.

When the retractable stiffener is a removable stiffener, each of the sidewalls adapted for a removable stiffener also may comprise a pocket. In such an embodiment, the removable stiffener may be insertable into and removable from the pocket.

Typical stiffeners include any sufficiently rigid flat lamina or panel which, when incorporated into the container sidewalls or when inserted into a sidewall pocket, lends form to the receptacle and ensures that it will remain in an open mode. The stiffener may be fabricated from any suitably firm and water impervious material as for example, plastic, wood, or rust-proof metals such as stainless steel or ceramic and the like; however, plastics derived from thermoplastic polymers such as Plexiglas® are preferred. Alternatively, the stiffeners may be fabricated from laminated materials as, for example, laminar layers of vinyl or a plurality of layers of the material of which the sidewalls are made. Also, in another embodiment, the holder can include a combination of stiffeners. For example, the sidewalls containing fixed stiffeners may be made of a plurality of layers of vinyl, or a plurality of layers of the material of which the sidewalls are made, while the stiffeners on the sidewalls adapted for retractable stiffeners are made of Plexiglas®.

The suspension means may be comprised of at least one cord, which is attached to at least one sidewall. The suspension means may also include at least one suction means, which is attachable to at least one of the sidewalls. The suspension means may also include the combination of at least one cord and at least one suction means. In addition, the cord may be made of a material, which may belong to a group consisting essentially of vinyl, nylon, cotton, polyester, hemp, rubber and plastic. Alternatively, the cord may be made of metal, which could be in a chain, and which may belong to a group consisting essentially of nickel, stainless steel, aluminum and nickel-plated metal.

The suspension means of the portable holder for articles of the current invention may further comprise at least one hook, which is attachable to the cord and may be attached to a fixture onto which the container may be suspended. In addition, the holder may have at least two cords, wherein each cord may further comprise a ring. The rings are attachable to at least one of the hooks in a manner whereby the suspension length of cord is shortened.

Attached to at least one sidewall of the portable holder is an exterior pouch whose lower portion includes a plurality of perforations to provide drainage means. Also included, on the same or a different sidewall, are ringlets arranged in series to provide holding means for a toothbrush or similar type item.

The holder of this invention is particularly suitable for use in a bathing area since it may be suspended onto a fixture of a bathtub, shower, sauna, hot tub, Jacuzzi®, pool, or the like, including the feeder line of a shower head, or to a soap dish, towel rack, shower curtain rod, door, faucet, rail, protrusion, or a wall or similar support.

The portable holder for articles of the current invention is waterproof and mildew-proof. After use, it may be wiped dry.

The portable holder for articles of the current invention may further comprise a storage pouch, in which the holder may be stored or transported, when not in use. The invention provides a portable holder for articles that may be packed and transported with luggage after it is used without dampening adjacent luggage items.

Other uses and advantages of this invention will become apparent from the following description taken in connection with the accompanying drawings, which are presented by way of illustration and example.

BRIEF DESCRIPTION OF THE DRAWINGS

Referring now to the drawings where like-numerals represent like-parts in several views:

FIG. 13 is a partial side elevational view of the portable holder of the present invention showing a hinge and slide bolt assembly;

FIG. 14 is a cross-sectional view taken along line 14—14 of FIG. 13;

FIG. 15 is a cross-sectional view taken along line 15—15 of FIG. 13;

FIG. 16 is a partial side elevational view of the portable holder of the present invention showing a living hinge;

FIG. 17 is a cross-sectional view taken along line 17—17 of FIG. 16; and FIG. 18 is a cross-sectional view taken along line 18—18 of FIG. 16.

DETAILED DESCRIPTION OF THE PREFERRED EMBODIMENT

The holder of this invention may be of any desired size and, therefore, the references hereinafter made to numerical ranges and/or precise measurements are for illustration purposes only or to illustrate a preferred embodiment, but they are not meant to be limitative.

Figure 1:
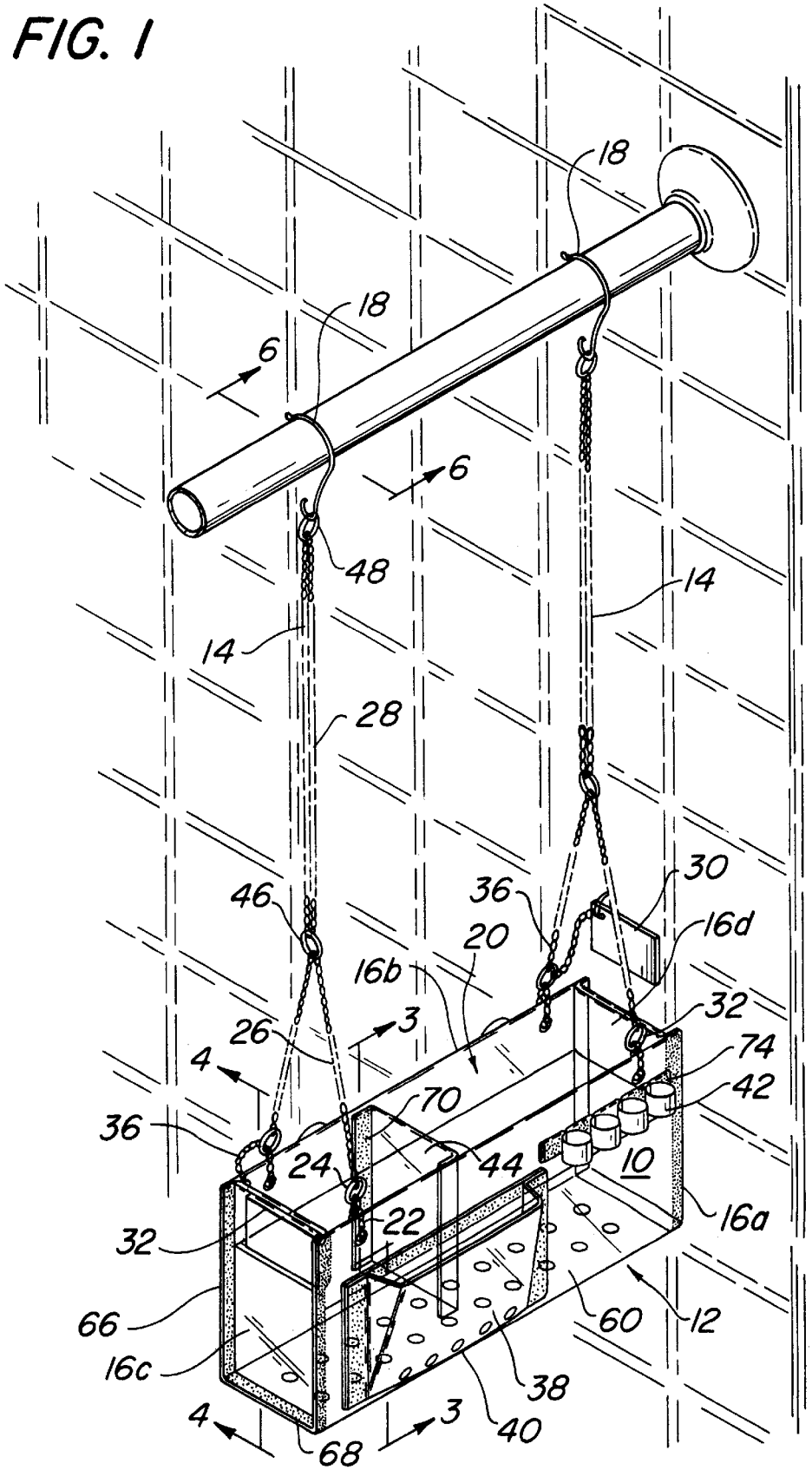
FIG. 1 is a front elevational view of the portable holder of the present invention showing the holder suspended from a shower curtain rod.

Reference is now made to FIG. 1, which illustrates an exemplary portable holder 10 in accordance with the present invention. As shown, the holder 10 includes a container 12 and suspension means in the form of two cords 14 and a pair of hooks 18.

The container 12 is comprised of a bottom panel 60 and four sidewalls that include two flat longitudinally extending members or sidewalls 16*a,* 16*b* disposed opposite one another, and two flat terminal members or sidewalls 16*c,* 16*d* disposed opposite one another. The sidewalls 16*a,* 16*b,* 16*c,* 16*d* and bottom panel 60 define an interior cavity 20. Each sidewall 16*a,* 16*b,* 16*c,* 16*d* contains a top portion, a bottom portion, a left side portion, and a right side portion.

The two terminal sidewalls 16*c,* 16*d* each are adapted to contain a retractable stiffener. In this embodiment, the retractable stiffener is a removable stiffener. The removable stiffener is made of a Plexiglas® strip 30, which is insertable into a pocket 32 located in the top portion of the sidewall 16*c,* 16*d* adapted to contain a removable stiffener. In a preferred embodiment, the pocket 32 is 1½ inches deep. It is to be noted that although the preferred location of the pocket 32 is in the top portion of the sidewall 16*c,* 16*d,* the pocket 32 could be located anywhere along the sidewall 16*c,* 16*d.*

While the removable stiffener used in this embodiment is made of Plexiglas®, it is to be understood that any material that stiffens could be used. Accordingly, the removable stiffener could be made of the material of which the sidewall is made as, for example, plastic, metal, glass, fiberglass, rubber, Styrofoam®, and the like. In practice, each Plexiglas® strip 30 is inserted into the pocket 32 when the holder is in use. The Plexiglas® strips 30 serve the purpose of maintaining the cavity 20 in an open position, stabilizing the container 12, and maintaining a rigid opening to the cavity 20 when the holder 10 is in use.

Advantageously, when the holder 10 is not in use, each of the Plexiglas® strips 30 can be removed from its respective pocket 32, thereby enabling each terminal sidewall 16*c,* 16*d* to be folded both vertically and horizontally for transport and/or storage. In a preferred embodiment, each Plexiglas® strip 30 is 2 inches long, 1¼ inches wide, and ⅛ inch thick.

The two longitudinally extending sidewalls 16*a,* 16*b* that are not adapted for removable stiffeners contain fixed stiffeners. In this preferred embodiment, the dimensions of the longitudinally extending sidewalls 16*a,* 16*b* are 6 inches by 11½ inches. The dimensions of the terminal sidewalls 16*c,* 16*d* adapted for removable stiffeners are 6 inches by 3½ inches.

In a preferred embodiment, the bottom panel 60 (FIG. 3) is 3½ inches by 11½ inches.

The container in the current embodiment also includes an exterior pouch 38. The exterior pouch 38 is attached to the exterior surface of one of the longitudinally extending sidewalls 16*a*. The exterior pouch 38 in this embodiment is made of 16 gauge clear, soft vinyl and has the dimensions of 5 inches wide by 3 inches high. The dimension of the exterior pouch allowing for the pouch to be expanded is 7 inches wide by 4¼ inches high. However, it is to be understood, that the inclusion of, size of, and the material comprising the exterior pouch are discretionary.

Perforations or a pattern of reticulated openings 40 is included on the bottom portion of the exterior pouch 38 to enable liquids to drain from the pouch.

The current embodiment further contains a plurality of ringlets 42 attached to the exterior surface of one of the longitudinally extending sidewalls 16*a*. The ringlets enable the user of the holder 10 to hang additional items on the exterior of the container 12. The additional items could include toothbrushes, razors, mirrors, and the like. In this embodiment, the ringlets 42 are ½ inch in height and are made of 16-gauge soft vinyl. It is to be understood, however, that the inclusion of, number of, size of and the material from which the ringlets are made are discretionary.

A divider in the form of a separation strip 44 is provided in the cavity 20 of the container 12. The separation strip 44 is comprised of 16-gauge clear soft vinyl in this embodiment. It is attached in a perpendicular manner to each of the two longitudinally extending sidewalls 16*a,* 16*b*. The separation strip 44 is attached at the top portion of each longitudinally extending sidewall 16*a,* 16*b* and extends down each sidewall 16*a,* 16*b* approximately three-quarters of the height of the sidewalls 16*a,* 16*b*. In this embodiment, the longitudinally extending sidewalls 16*a,* 16*b* are 6 inches tall, and the separation strip 44 is approximately 4¼ inches long and 3½ inches wide. It is to be understood that the inclusion of, location of, length of, and material from which the separation strip 44 is made are discretionary.

In this embodiment, the exterior pouch 38, the ringlets 42, and the separation strip 44 each is glued to the longitudinally extending sidewalls 16*a,* 16*b* of the container 12; however, other means of fastening these elements to the container 12 may be employed. For example, the elements could be heat pressed, sewn, stapled, or the like to the container 12.

Two cords 14 and a pair of hooks 18 are employed in this embodiment as a suspension means to suspend the container from an overhead support, which is in the form of a shower curtain rod. Each cord 14 in this embodiment is comprised of a series of segments and rings. The cord 14 contains two connecting segments 22 that are attached to the top portion of each of two longitudinally extending sidewalls 16*a,* 16*b* that are opposite one another. Each connecting segment 22 is also attached to a first ring 24. An intermediate segment 26 is attached to each first ring 24 on one end, and to a second ring 46 on the opposite end. The two intermediate segments 26 attach to the same second ring 46. From the second ring 46, two suspension segments 28 are affixed. The suspension segments 28 attach to a third ring 48. The hook 18 also is attached to the third ring 48. Each hook 18, hooks over the top of the shower curtain rod in this embodiment.

Preferably, the cords are made from materials that are economical, of high tensile strength and rust resistant. In this embodiment, the cord is made from stainless steel chain link segments and stainless steel metal rings. However, nickel-plated metal, copper, aluminum, and the like may be used. In addition, the cords could be comprised of a combination of a metal and non-metal materials. For example, the chain-link portions could be replaced with fabric cords. Any kind of fabric cord could be used, including, nylon, cotton, polyester, hemp and the like. Alternatively, the cord could be made of metal that is not in a chain link or of other materials such as plastic, rubber, and the like. Also, the rings could be made of any of the materials from which the cords may be made.

While this preferred embodiment utilizes two cords 14, each 20 inches long, in the suspension means, the holder 10 could be suspended by a single cord attached to only one longitudinally extending sidewall 16*a* or attached to two longitudinally extending sidewalls 16*a,* 16*b*. The length of the cord is discretionary. In addition, the specific connecting segment 22, intermediate segment 26 and/or suspension segment 28 could be omitted. Similarly, the first ring 24, second ring 46, and/or third ring 48 could be omitted. If the first ring 24 or the third ring 48 were omitted, the sidewall 16 or the hook 18, respectively, would be directly attached to the cord.

In this embodiment, each Plexiglas® strip 30 is attached to the first ring 24 by means of a retaining cord 36. It is to be understood that while the retaining cord 36 in this preferred embodiment is made of metal chain link, it could be replaced by a retaining cord of any material or by a tab or the like while maintaining the spirit of the invention. In addition, while the retaining cord 36 prevents the Plexiglas® strips 30 from being lost when they are not in their respective pockets 32, the inclusion of the retaining cord 36 is optional.

This embodiment further shows that the left side portion of one longitudinally extending sidewall 16*a* may be joined with the right side portion of the adjacent terminal sidewall 16*c* in a heat-pressed manner that creates a bonded material flap 66 where the adjacent sidewalls are attached. All of the sidewalls 16*a,* 16*b,* 16*c,* 16*d* are attached in this manner, thereby creating at least four bonded material flaps 66. It is to be understood, however, that the manner in which the holder 10 is constructed is discretionary. Accordingly, the addition of bonded material flaps 66 is discretionary. For example, the sidewalls 16 could be sewn, thereby creating a seam rather than a bonded material flap.

In addition in this embodiment, the bottom panel is joined with the two terminal sidewalls 16*c,* 16*d* that are located opposite one another in a manner whereby the bottom portion of each sidewall 16 and the bottom panel create a bonded material flap 68. In a preferred embodiment, the two longitudinally extending sidewalls 16*a,* 16*b* and the bottom panel 60 are one continuous piece of material that is folded at the bottom portion of each sidewall 16*a,* 16*b*. Each terminal sidewall 16*c,* 16*d* is heat pressed to the longitudinally extending sidewalls 16*a,* 16*b* at flap 66 and to the bottom panel 60 at flap 68.

Also in this embodiment, the separation strip 44 is heat pressed to the longitudinally extending sidewalls 16*a,* thereby creating bonded material flaps 70. The exterior pouch 38 is glued to one of the longitudinally extending sidewalls 16*a*. Likewise, the ringlets 42 are integrally attached to a strip 74 of vinyl material that is glued to the sidewall 16*a*.

Figure 2:
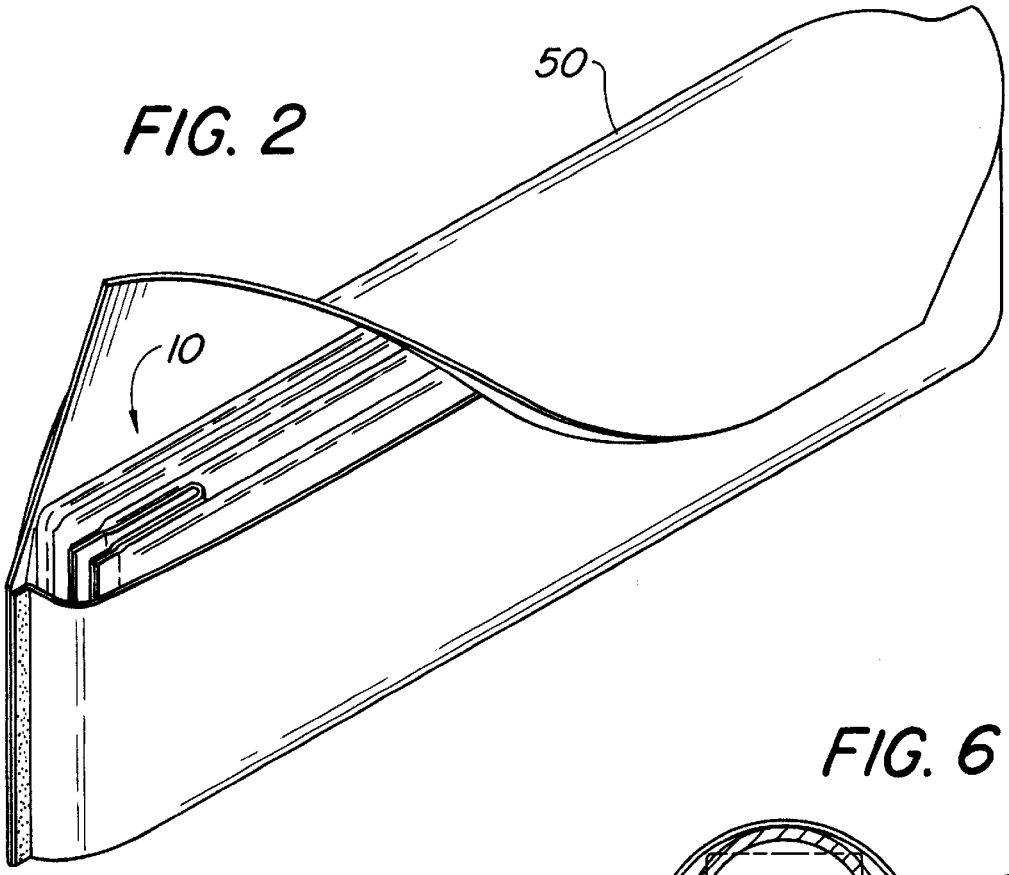
FIG. 2 is a front elevational view of the portable holder of the present invention shown in kit form folded and packed inside a carrying case.

FIG. 2 shows the portable article holder of the current invention folded into a carrying case 50. The carrying case 50 is constructed in an envelope fashion. While any material may be used, preferable materials are breathable materials, which also are impervious to moisture. In this embodiment, the carrying case is made of 16-gauge soft vinyl. However, any material could be used to construct the carrying case 50.

Figure 3:
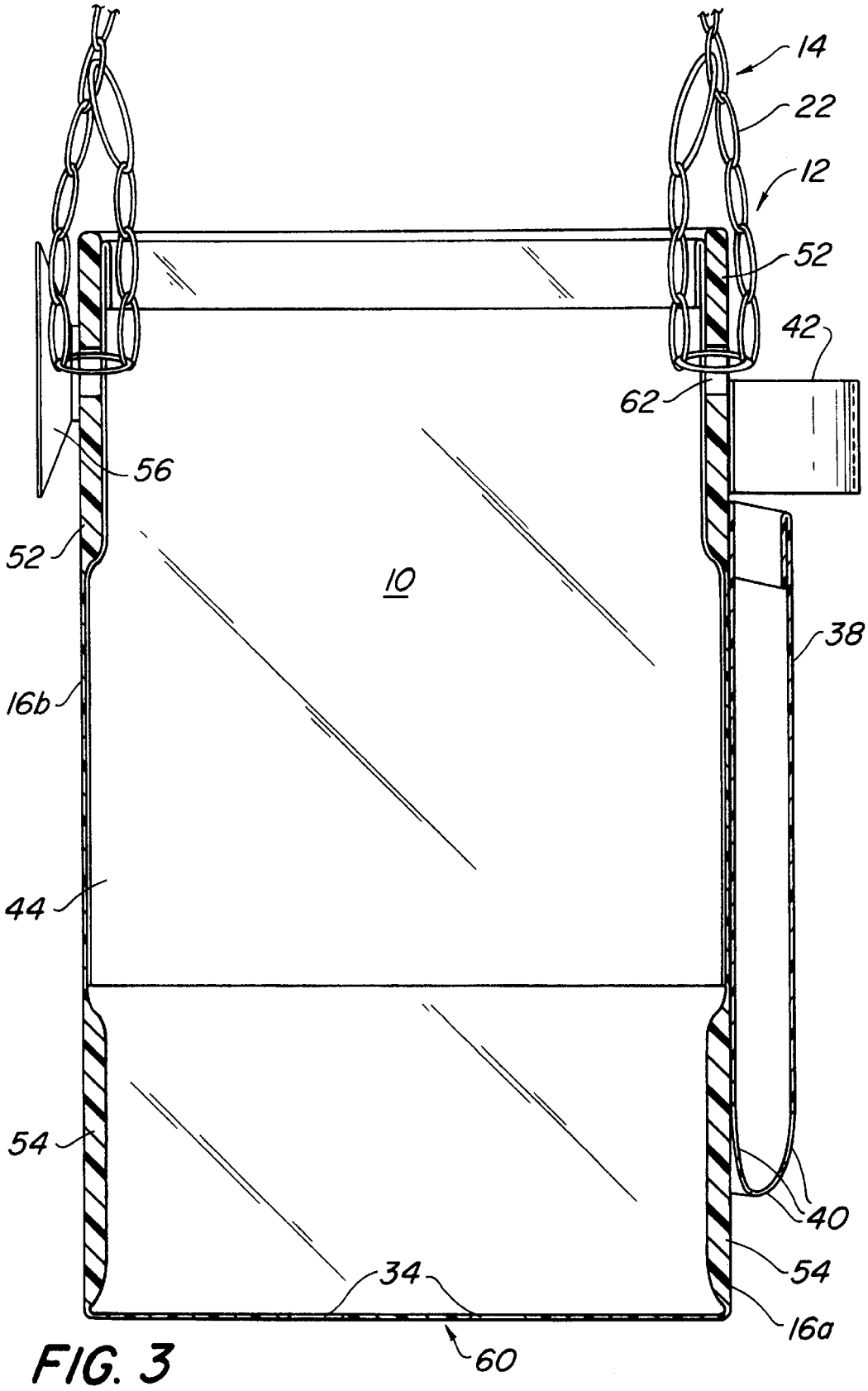
FIG. 3 is a cross-sectional view taken along line 3—3 of FIG. 1.

FIG. 3 is a cross-sectional view taken along line 3—3 of FIG. 1. This view illustrates two longitudinally extending sidewalls 16*a,* 16*b,* each containing fixed stiffeners. Each sidewall 16*a,* 16*b* contains a top portion stiffener 52 and a bottom portion stiffener 54. In this embodiment, the stiffener is in the form of a plurality of layers of the material used to make the container 12. While a variety of materials can be used to construct the container 12, in this preferred embodiment, the material is 16-gauge clear, soft vinyl. Other materials, which could be used, include plastic, cotton, polyester, rubber, nylon, polyester, and the like, or a combination thereof. Also, any gauge of the material could be used that provided sufficient strength. In addition, while in this preferred embodiment, a plurality of layers of material are used to comprise the top portion stiffener 52 and the bottom portion stiffener 54, the type of stiffener is discretionary. Accordingly, other stiffeners could be used, including Plexiglas® strips, Styrofoam®, aluminum, plastic, and the like. In a preferred embodiment, the top portion stiffener 52 and the bottom portion stiffener 54 each would be 10½ inches long, 1¼ inches wide, and ⅛ inch thick. However, the dimensions of the stiffeners are discretionary. In addition, a combination of stiffeners could be used on one container 12.

The bottom panel 60 contains a plurality of perforations 34 for drainage of liquids.

This embodiment further shows that the separation strip 44 extending approximately two-thirds down the height of the longitudinally extending sidewalls 16*a,* 16*b.*

Also illustrated in this embodiment is the opening 62 in each of the longitudinally extending sidewalls 16*a,* 16*b* and the top portion stiffener 52 through which the connecting segment 22 of the cord 14 passes. In addition to the cords 14 and hooks 18, the holder 10 in this embodiment includes as a suspension means at least one suction means in the form of a suction cup 56. The suction cup 56 in this embodiment is attached to the top portion of the longitudinally extending sidewall 16*b.* In a preferred embodiment, three 2-inch suction cups 56 are provided. It is to be understood that the location and number of suction cups 56 are discretionary, as long as the suction strength is sufficient to suspend the holder 10 and the articles placed therein from a horizontal surface. It is to be further understood that the holder 10 of the present invention could be suspended by at least one suction cup 56, by a pair of cords 14, by a single cord (not shown in this embodiment), or by a combination of suction cups 56 and cords 14.

It is also to be understood that while hooks, cords, and suction means are disclosed as suspension means, additional suspension means could be used. Accordingly, any device that suspends the holder 10 may be used. Other suspension devices could include rings, nets, clips, pedestals, posts, and the like.

As illustrated in this embodiment, the exterior pouch 38 is constructed of a separate pouch that is formed by a piece of vinyl, preferably 7 inches by 8½ inches, that is folded in half and glued to the sidewall 16*a.* The pouch 38 contains a pattern of reticulated openings 40 that are located both on the side of the pouch 38 adjacent to the sidewall 16*a* and on the side of the pouch 38 opposite the sidewall 16*a.* However, the location and number of openings 40 is variable as long as liquid that gathers in the exterior pouch 38 is able to drain from the pouch 38. In addition, the pouch 38 could be made from one layer of material that is attached to the sidewall 16*a* by means of heat pressing, gluing, sewing, stapling and the like.

Figure 4:
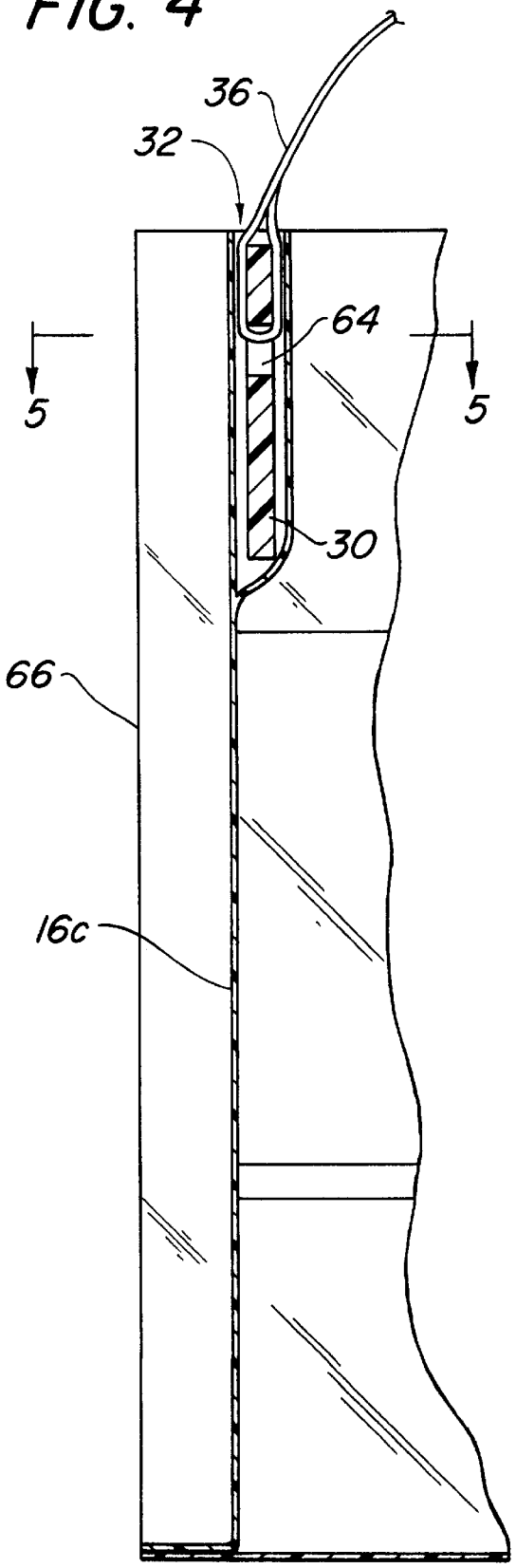
FIG. 4 is a cross-sectional view taken along line 4—4 of FIG. 1.

FIG. 4 is a cross-sectional view taken along line 4—4 of FIG. 1. This view clearly shows the pocket 32 into which the Plexiglas® strip 30 is inserted.

The Plexiglas® strip 30 contains an opening 64 through which the retaining cord 36 passes. The pocket 32 is a cavity that is created by separating into at least two layers the material of which each sidewall 16*c,* 16*d* is made.

It can be seen that the pocket 32 is created by the space formed between at least two separated layers of the sidewall material. Alternatively, the pocket 32 could be formed by the sidewall 16*c,* 16*d* on one side of the pocket and the addition of another piece of material on the other side of the pocket. Still further, the pocket could be constructed separately from a variety of materials, and thereafter attached to the sidewall 16*c,* 16*d* by means of gluing, heat pressing, sewing, stapling and the like. Ultimately, the material and manner of constructing the pocket 32 is discretionary, as long as the removable stiffener is capable of being inserted into and removed from the pocket. In still another embodiment (not shown), the removable stiffeners could be attached to the sidewall 16*c,* 16*d* by means of hook and loop material sold under the trademark Velcro®, snaps, guide means and the like.

Figure 5:
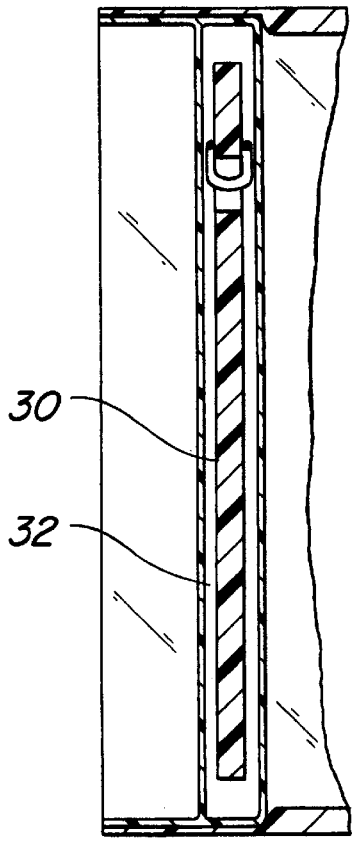
FIG. 5 is a cross-sectional view taken along line 5—5 of FIG. 4.

FIG. 5 is a cross-sectional view taken along line 5—5 of FIG. 4. Essentially, FIG. 5 shows a perspective view of the pocket 32 into which the Plexiglas® strip 30 has been inserted.

Figure 6:
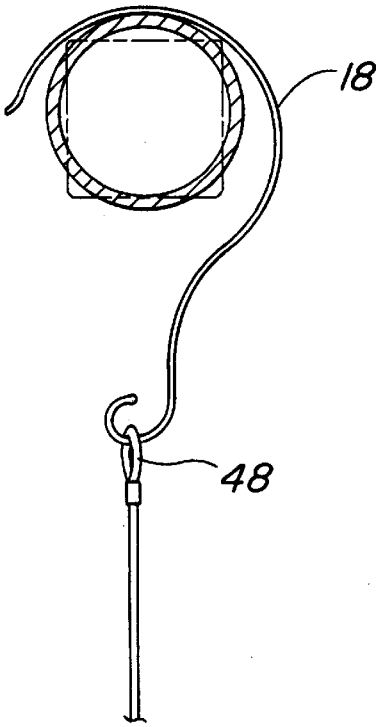
FIG. 6 is a cross-sectional view taken along line 6—6 of FIG. 1.

FIG. 6 is a cross-sectional view taken along line 6—6 of FIG. 1. In FIG. 6, there is shown a partial cross-sectional view of a hook 18 whose configuration makes it particularly suitable for use with support bars of rounded, squared, or rectangular configurations. For example, when the cross-section of the bar is round (as shown in FIG. 6,) the rounded top portion of hook 18 serves as the contact point between hook and bar. On the other hand, when the support bar is square or rectangular in cross-section (shown in FIG. 6 in phantom,) the bar comes into contact with said hook at two points on the rounded top portion. This embodiment provides another manner by which the portable article holder 10 of the current invention may be suspended from a variety of supports, including shower curtain rods, door frames, rails, soap dishes, showerheads, faucets, walls and the like. This illustration also shows that the hook could be attached to a square-shaped shower curtain rod, frame, door, bar, or the like. The third ring 48 attaches the cord to the hook 18.

Figure 7:
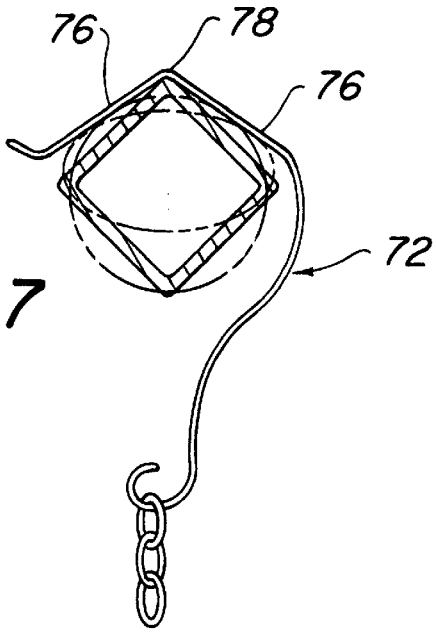
FIG. 7 is a partial cross-sectional view of an alternative hook means for suspending the holder of this invention from an accommodating bar.

In FIG. 7, there is shown a partial cross-sectional view of a hook 72 whose oblique configuration makes it particularly suitable for use with support bars of almost any configuration. For example, when the cross-section of the bar is square (as shown in FIG. 7,) the inclined sides 76 of hook 72 form a vertex 78 which serves as the sole contact point between hook and bar. On the other hand, when the support bar is elliptical or circular in cross-section (shown in FIG. 7 in phantom,) the bar comes into contact with said hook on each of its inclined sides. This embodiment provides another manner by which the portable article holder 10 of the current invention may be suspended from a variety of supports, including shower curtain rods, door frames, rails, soap dishes, showerheads, faucets, walls and the like. The oblique sides 76 of the hook 72 also enhance the hanging properties of the hook on non-rounded surfaces, such as diagonal, square, and rectangular surfaces.

Figure 8:
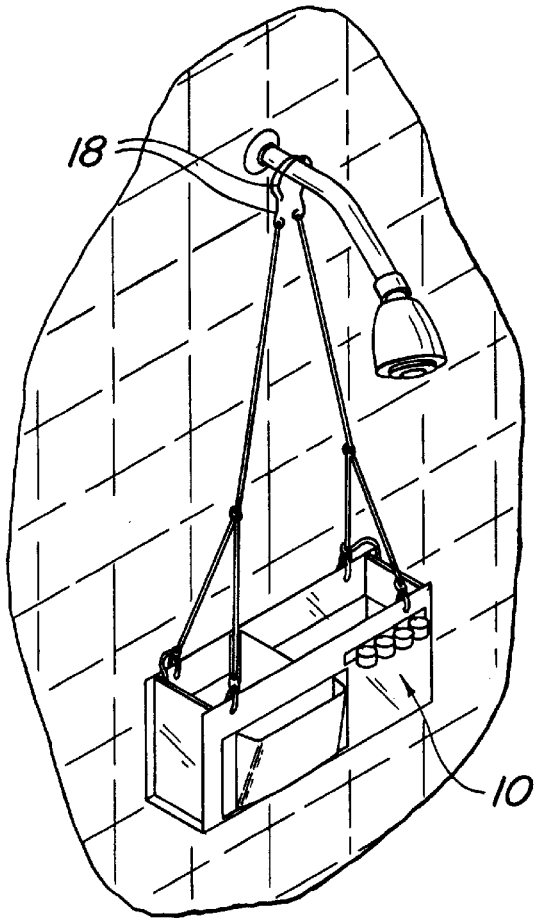
FIG. 8 is a front elevational view of the portable holder of the present invention shown suspended from the feeder line of a showerhead.

FIG. 8 is a front elevational view of the portable article holder 10 of the present invention wherein the holder 10 is suspended from a feeder line of a showerhead. In this embodiment, two hooks 18 are joined together over the top of the feeder line.

Figure 9:
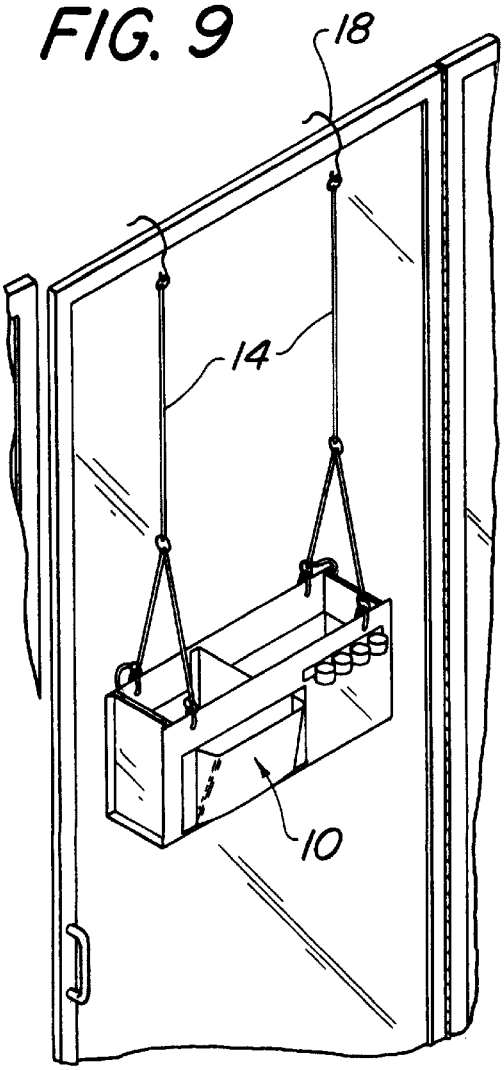
FIG. 9 is a front elevational view of the portable holder of the present invention wherein the holder is shown suspended from a door.

FIG. 9 is a front elevational view of the portable article holder 10 of the present invention in which the holder 10 is suspended from the top of a door. In this embodiment, each of two cords 14 is suspended perpendicularly from the horizontal plane of the holder 10. It is to be noted that the holder 10 could be suspended over any kind of door in this illustrated manner. The doors could include sauna doors, shower doors, bathroom doors, pool doors, and the like. In addition, the holder 10 could be suspended over the top of any kind of wall in this manner.

Figure 10:
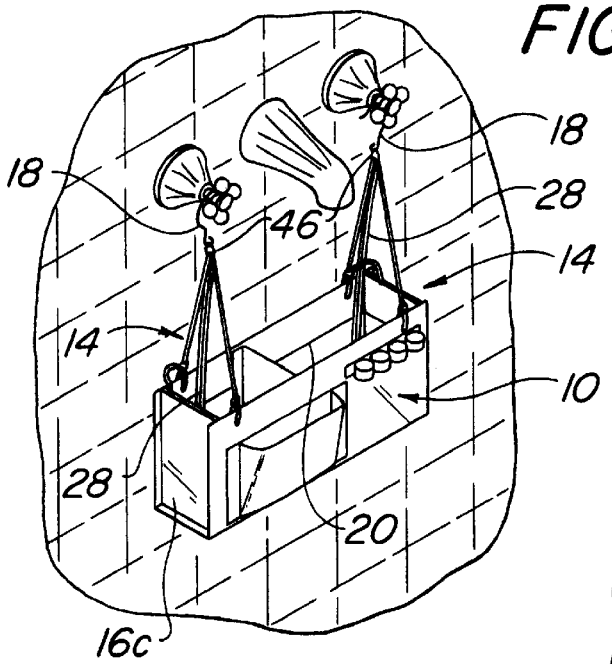
FIG. 10 is a front elevational view of the portable holder of the present invention wherein the holder is shown suspended from a water faucet assembly.

FIG. 10 is a front elevational view of the portable article holder 10 of the present invention in which the holder 10 is suspended from a water faucet assembly. In this embodiment, a hook 18 is attached to each of two cords 14 at the second ring 46. In this manner, the length of the cord 14 is reduced by the length of the suspension segment 28. The suspension segment 28 is allowed to fall downward, either falling into the cavity 20 of the holder, or along the outside of the sidewall 16*c,* 16*d.*

Figure 11:
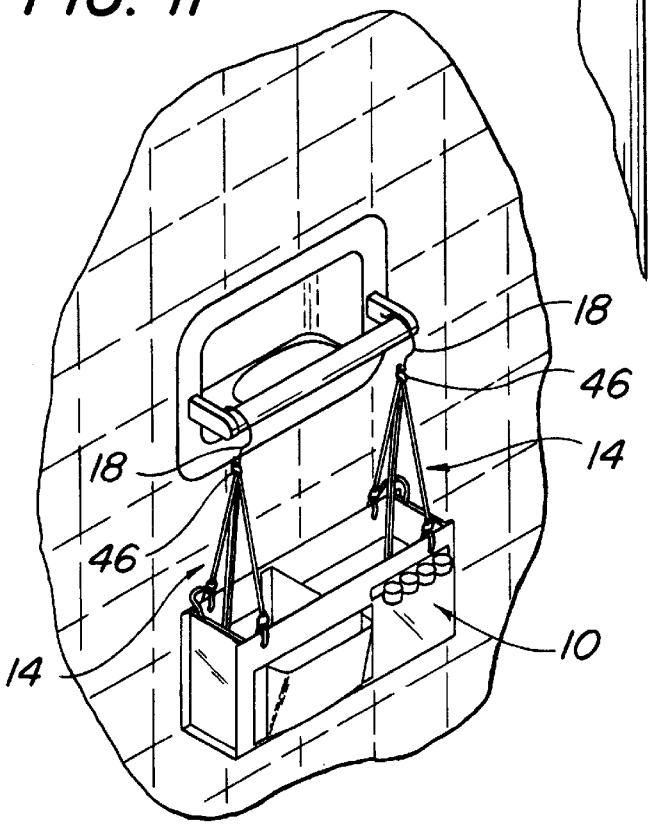
FIG. 11 is a front elevational view of the portable holder of the present invention wherein the holder is shown suspended from a soap dish fixture.

FIG. 11 is a front elevational view of the portable article holder 10 of the present invention in which the holder 10 is suspended from a soap dish. In this embodiment, a hook 18 is attached to each of two cords 14 at the second ring 46. While the bar of a soap dish holder is illustrated in this embodiment, it is to be understood that the holder 10 could be suspended in this manner from any projecting surface in the vicinity of the use of the holder 10.

Figure 12:
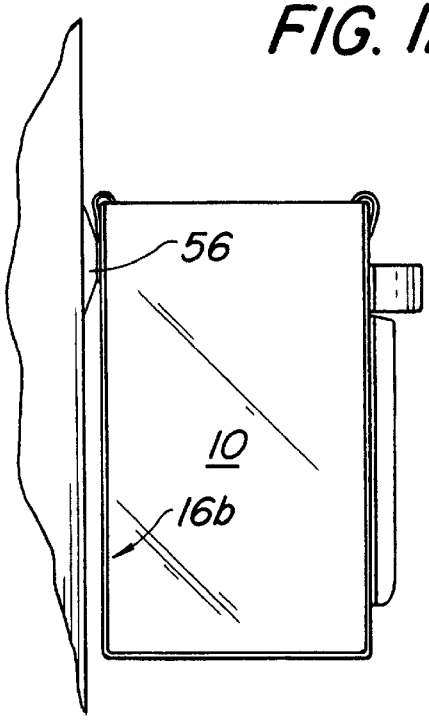
FIG. 12 is a cross-sectional view of the portable holder for articles of the present invention wherein the holder is shown to be suspended from a horizontal surface by suction cup means.

FIG. 12 is a cross-sectional view of the portable article holder 10 of the present invention wherein the holder is suspended from a horizontal surface by at least one suction cup 56. The suction cup 56 is attached to the top portion of a sidewall 16*b.* The suction cup attaches the holder 10 to a horizontal surface by suction means that are well known in the art.

Reference is now made to FIG. 13, which is a partial side elevational view of the portable holder of the present invention showing a hinge and slidebolt assembly, FIG. 14, which is a cross-sectional view taken along line 14—14 of FIG. 13, and FIG. 15, which is a cross-sectional view taken along line 15—15 of FIG. 13. In this embodiment, the retractable stiffener is comprised of a hinge 96 attached to a plurality of stiffening members 90*a,* 90*b.* The hinge 96 utilized in this embodiment is a standard hinge that is well known in the art. In addition, the slide-bolt assembly 92 accompanying the hinge 96 is well known in the art. The hinge 96 and slide-bolt assembly 92 can be made of any material sufficiently stiff to maintain the sidewall 16*c,* 16*d* in an open position when the bolt 86 is engaged. Materials that could be used include metals, plastics, glass, cork, and the like.

It is to be noted that although the preferred location of the hinge 96 and slide-bolt assembly 92 is in the top portion of the sidewall 16*c,* 16*d,* they could be located anywhere along the sidewall 16*c,* 16*d.*

The hinge 96 includes a plurality of wings 80*a,* 80*b* and a wing interface 82. Each of the wings 80*a,* 80*b* of the hinge 96 is attached to a corresponding stiffening member 90*a,* 90*b.* The wings 80*a,* 80*b* can be attached to the stiffening members 90*a,* 90*b* by any of numerous attachment means known on the art, including glue, heat pressing, tape, staples, hook and loop material and the like.

The stiffening members 90*a,* 90*b* are made of plastics derived from thermal plastic polymers such as Plexiglas®. However, it is to be understood that any material that stiffens could be used. Accordingly, the stiffening members could be made of the material of which the sidewall is made as, for example, plastic, metal, glass, fiberglass, rubber, Styrofoam®, and the like.

In this embodiment, each stiffening member 90*a,* 90*b* is encased in between two layers 94*a,* 94*b* of the material used to construct the sidewall 16*c,* 16*d.* In this embodiment, the material is 16-gauge vinyl. Alternatively, the stiffening members 90*a,* 90*b* could be encased by a layer of material 94*a* to construct the sidewall 16*c,* 16*d* on one side and the addition of another piece of material (not shown) on the other side. Still further, the stiffening members 90*a,* 90*b* could be encased in a pocket (not shown) that could be constructed separately from a variety of materials, and thereafter attached to the sidewall 16*c,* 16*d* by means of gluing, heat pressing, sewing, stapling and the like. In still another embodiment (not shown), the stiffening members 90*a,* 90*b* could be attached to the sidewall 16*c,* 16*d* by means of hook and loop material sold under the trademark Velcro®, snaps, guide means, gluing, heat pressing, and the like. In addition, stiffening members 90*a,* 90*b* could be integrally made a part of the sidewall 16*c,* 16*d* similar to the construction of the fixed stiffeners 52, 54 previously described.

When the hinge 96 and slide-bolt assembly 92 are in a stiffening mode, they serve the purpose of maintaining the cavity 20 in an open position, stabilizing the container 12, and maintaining a rigid opening to the cavity 20 when the holder 10 is in use. In a stiffening mode, the hinge 96 is in an opened position whereby the wings 80*a,* 80*b* lie on the same horizontal plane. In addition, the stiffening members 90*a,* 90*b* lie on the same horizontal plane. Preferably, a space 98 is provided between the two stiffening members 90*a,* 90*b.* In a preferred embodiment, when the stiffening members 90*a,* 90*b* lie on the same horizontal plane their combined dimensions, along with the space 98, are 2 inches long, 1¼ inches wide, and ⅛ inch thick.

Also, the slide-bolt assembly 92 can be engaged to maintain the hinge 96 in an opened position. The encasement 84 of the slide-bolt assembly 92 is attached to one of the stiffening members 90*a* on the side opposite the cavity 20 of the container 12. To engage the slide-bolt assembly 92, the bolt 86 is slid out of the encasement 84 by means of the knob 88. When the bolt 86 is slid outward, it engages the stiffening member 90*b* that is not attached to the encasement 84. The engaged slide-bolt assembly 92 prevents the wings 80*a,* 80*b* from retracting. While the inclusion of the slide-bolt assembly 92 is preferred, the slide-bolt assembly 92 can be omitted if the hinge 96, without use of a slide-bolt assembly 92, is capable of maintaining the cavity 20 in an open position, stabilizing the container 12 and maintaining a rigid opening to the cavity 20 when the holder 10 is in use.

Preferably, when the stiffening members 90*a,* 90*b* are encased between the layers of 94*a,* 94*b,* of the material used to construct the sidewalls 16*c,* 16*d,* the hinge 96 and slide-bolt assembly 92 are not encased between the two layers 94*a,* 94*b* of material. Rather the hinge 96 and the slide-bolt assembly 92 are attached to the outer portion of the layer 94*a* of the material facing outward, rather than the layer of the material 94*b* facing the cavity 20 of the container 12. Similarly, if a pocket (not shown) or another piece of material (not shown) is used to encase the stiffening members 90*a,* 90*b,* the hinge 96 and the slide-bolt assembly 92 would be attached to the outer portion of the pocket or piece of material.

In addition, the stiffening members 90*a,* 90*b* are more easily retracted when the interior layer 94*b* of the material used to make the sidewall 16*c,* 16*d* contains a slit along the space 98.

To retract the stiffening members 90*a,* 90*b,* the bolt 86 is retracted into the bolt encasement 84 by means of the knob 88. Thereafter, the hinge 96 is pushed inward so that the angle between the two wings 80*a,* 80*b* and the two stiffening members 90*a,* 90*b* is decreased from 190 degrees toward zero degrees. The space 98 between the two stiffening members 90*a,* 90*b,* would become greater as the wing interface 82 portion of the hinge 96 is pushed forward. Pushing the hinge interface 82 forward causes the hinge 96 to retract.

Reference is now made to FIGS. 16, 17, and 18. FIG. 16 is a partial side elevational view of the portable holder of the present invention showing a living hinge. FIG. 17 is a cross-sectional view taken along line 17—17 of FIG. 16. FIG. 18 is a cross-sectional view taken along line 18—18 of FIG. 16. In this embodiment, a self-sustaining hinge, commonly known in the art as a "living hinge" 100 is utilized as the retractable stiffener of the sidewalls 16*c,* 16*d* containing retractable stiffeners. The living hinge 100 contains a plurality of stiffening wings 102*a,* 102*b* and a pliable portion 106. The living hinge 100 in this embodiment is made of plastic. However, the living hinge can be made of any of the materials known in the art to construct this type of hinge. Generally, the material forming the pliable portion 106 of the hinge must contain a memory so that the material will go back to it original shape after folding.

In addition, the stiffening wings 102*a,* 102*b* could be made of a material that differs from the material used to make the pliable portion 106 of the living hinge 100. Accordingly, the stiffening wings 102*a,* 102*b* could be made of any material that stiffens, such as plastics derived from thermal plastic polymers such as Plexiglas®, or the material of which the sidewall is made as, for example, plastic, metal, glass, fiberglass, rubber, Styrofoam®, and the like.

In this embodiment, the living hinge 100 is encased in between two layers 104*a,* 104*b* of the material used to construct the sidewall 16*c,* 16*d.* Alternatively, the living hinge 100 could be encased by the sidewall 16*c,* 16*d* on one side and the addition of another piece of material (not shown) on the other side. Still further, the living hinge 100 could be encased in a pocket (not shown) that could be constructed separately from a variety of materials, and thereafter attached to the sidewall 16*c,* 16*d* by means of gluing, heat pressing, sewing, stapling and the like. In still another embodiment (not shown), the living hinge 100 could be attached to the sidewall 16*c,* 16*d* by means of hook and loop material sold under the trademark Velcro®, snaps, guide means, gluing, heat pressing, and the like. In addition, the living hinge 100 could be integrally made a part of the sidewall similarly to the construction of the fixed stiffeners 52, 54 previously described.

In addition, the stiffening wings 102*a,* 102*b* are more easily retracted when the interior layer 94*b* of the material used to make the sidewall 16*c,* 16*d* contains a slit along the space 108.

To utilize the living hinge 100, the user would press the pliable portion 106 of the hinge toward the interior of the cavity 20. This would cause the angle between the two stiffening wings 102*a,* 102*b* to decrease from 180 degrees toward zero degrees. The space 108 between the two stiffening wings 102*a,* 102*b,* would become greater as the pliable portion 106 is pushed forward. Pushing forward the pliable portion 106 causes the living hinge 100 to retract.

As well known in the art, the living hinge 100 automatically remains in an engaged state when pressure is not applied to the pliable portion 106. In the engaged state, the stiffening wings 102*a,* 102*b* are at an angle from one another which is 180 degrees.

When the living hinge 100 is in a stiffening mode, it serves the purpose of maintaining the cavity 20 in an open position, stabilizing the container 12, and maintaining a rigid opening to the cavity 20 when the holder 10 is in use. In a preferred embodiment, when the living hinge 100 is in a stiffening mode, its dimensions are 2 inches long, 1¼ inches wide, and ⅛ inch thick.

In the practice of the current invention, the portable article holder 10 can be folded when not in use. In order to fold the holder 10, the hooks 18 would be detached from the overhead support. In addition, retractable stiffeners of the terminal sidewalls 16*c,* 16*d* would be retracted. Accordingly, if the terminal sidewalls 16*c,* 16*d* have a hinge, 96 or 100, the hinge, 96 or 100, would be retracted. If the terminal sidewalls 16*c,* 16*d* contain removable stiffeners, the Plexiglas® strips 30 would be removed from the pockets 32. With the retractable stiffeners retracted, the terminal sidewalls 16*c,* 16*d* can be folded vertically in half. In addition, the longitudinally extending sidewalls 16*a,* 16*b,* along with the terminal sidewalls 16*c,* 16*d,* can be folded horizontally in half so that the bottom portion of each sidewall 16*a,* 16*b,* 16*c,* 16*d* is placed on top of its respective top portion. Thereafter, the cords 14 can be wrapped around the folded container 12. Finally, the holder 12 can be inserted into the carrying case 50.

In use, the portable article holder 10 could be utilized when the user has a need to contain items in a suspended holder. Such uses include accessing toiletries, bathing items, and bathing toys while the user utilizes a shower, bath, sauna, hot tub, Jacuzzi, pool and the like. To use the portable article holder illustrated in this embodiment, the holder 10 would be taken out of the carrying case 50. Thereafter, the cords 14 would be extended and hooked onto the overhead support and/or the suction cups would be attached to a horizontal surface. The container 12 would be unfolded. Next, the terminal sidewalls 16*c,* 16*d* would be stiffened. If the terminal sidewalls 16*c,* 16*d* contain hinges, 96 or 100, the hinges, 96 or 100, would be opened. If the hinge 96 contained a slide-bolt assembly 92, the bolt 86 would be slid outward from the bolt encasement 84. If the terminal sidewalls 16*c,* 16*d* contained removable stiffeners, the Plexiglas® strips 30 would be placed in the pockets 32 to maintain the container 12 in a stable, rigid and fully opened position.

Thereafter, the user could place items in the holder 10. Items that could be inserted into the cavity 20 include toiletries that are in their original containers. Such toiletries include bottles of shampoo, hair conditioner, shaving lotion, liquid soaps, hand lotions, and the like. In addition, a bar of soap, wash cloth, or the like could be placed in the exterior pouch 38. Also, razors, toothbrushes, mirrors, and the like could be placed in the ringlets 42. Any liquids, such as shower water, bath water, soapsuds, shampoo, and the like would drain from the container 12 through the plurality of perforations 34 on the bottom panel 60 and from the exterior pouch 38 through the reticular openings 40.

When the user wanted to transport the portable article holder 10, the user would remove the toiletries or other articles from the container 12. Thereafter, if the container 12 and the suspension means contained moisture, the user could simply wipe down the portable article holder 10 with a paper towel, terrycloth towel, or the like before preparing it for packing.

It is to be understood that the article holder 10 the present invention is particularly suited to be used to hold articles used in bathing areas. Such bathing areas include, but are not limited to bath tubs, showers, saunas, Jacuzzis, hot tubs, pools, and the like. However, it is also to be noted that the article holder of the present invention also may be used in areas other than bathing areas. In addition, the holder may be used for articles other than articles associated with bathing.

This invention has been described by reference to precise embodiments, but it will be appreciated by those skilled in the art that this invention is subject to various modifications and to the extent that those modifications would be obvious to one of ordinary skill, they are considered as being within the scope of the appended claims.

What is claimed is:

1. A portable article consisting essentially of:

(1) a container comprised of two flat longitudinally extending members disposed opposite one another, two oppositely disposed flat terminal sidewalls, and a bottom panel, all joined to one another to form, in combination, a cavity into which articles may be placed; each of said terminal sidewalls including a retractable stiffener, said container being foldable when each said stiffener is retracted; and (2) means for suspending said container from a support, said suspension means consisting essentially of one or more cords joined at one end to said longitudinally extending members and, at the opposite end, to one or more hooks for engaging an overhead support;

(3) said cord comprising:

(a) two connecting segments, each of which are separately attached to a longitudinally extending member;

(b) two first rings, each of which are individually attached to a said connecting segment;

(c) two intermediate segments, each of which are attached to a said first ring;

(d) a second ring, said second ring being attached to said intermediate segments at their respective ends, opposite said first ring;

(e) two suspension segments, each of which are attached to said second ring; and (f) a third ring, said third ring being attached to said two suspension segments at their respective ends, opposite said second ring; said third ring being further attached to a hook.

2. The article holder of claim 1 wherein each said retractable stiffener is comprised of a removable stiffener.

3. The article holder of claim 1 wherein each said retractable stiffener is comprised of a hinge.

4. The article holder of claim 2 wherein each said removable stiffener is an insert.

5. The article holder of claim 1, wherein at least one of said flat longitudinally extending members includes ringlets arranged in series to provide article-holding means.

6. The article holder of claim 4 wherein said insert is fitted into a pocket formed in each of said terminal sidewalls.

7. The article holder of claim 1 wherein said overhead support is the feeder line of a showerhead assembly.

8. The article holder of claim 1 wherein said overhead support is a shower curtain rod.

9. The article holder of claim 1 wherein said means for suspending said container is suction cup means and the support is a vertical surface.

10. The article holder of claim 1 wherein said container is flexible and can be folded for storage in a pouch to form a kit.

11. The article holder of claim 1 wherein said bottom panel is perforated to provide drainage means.

12. The article holder of claim 1, wherein said container further comprises a panel member joined at its opposite ends to the inner sidewalls of both of said longitudinally extending members so as to divide said cavity into two compartments.

13. The article holder of claim 1 wherein said container further comprises a pouch integrally joined to the outer sidewall of one of said longitudinally extending members.

14. The article holder of claim 13 wherein said pouch includes a pattern of reticulated openings to provide drainage means.

15. The portable holder for articles as described in claim 1 wherein said container is made of plastic.

16. The portable holder for articles as described in claim 1 wherein each of said two flat longitudinally extending members contains stiffening means, said stiffening means being integrally incorporated into each of said longitudinally extending sidewalls.

17. The portable holder for articles as described in claim 1 wherein said cord is selected from among vinyl, nylon, cotton, polyester, hemp, rubber, and plastic.

18. The portable holder for articles as described in claim 1 wherein said cord is made of metal.

19. The portable holder for articles as described in claim 18 wherein said metal is selected from among nickel, stainless steel, aluminum, and nickel-plated metal.

20. The portable holder for articles as described in claim 1, wherein said hook is comprised of two inclined sides which, in combination, impart to said hook an oblique configuration.

21. The portable holder as described in claim 1 comprised of two cords, each of which are disposed opposite one another on said longitudinally extending members, wherein each second ring on said cord is attachable to said hook in a manner whereby the length of each said cord is shortened by the combined length of said suspension segment and said third ring.

22. A portable article holder consisting essentially of:

(1) a container comprised of two flat longitudinally extending members disposed opposite one another, two oppositely disposed flat terminal sidewalls, and a bottom panel, all joined to one another to form, in combination, a cavity into which articles may be placed; each of said terminal sidewalls including a retractable stiffener, said container being foldable when each said stiffener is retracted;

(2) a panel member joined at its opposite ends to the inner sidewalls of both of said longitudinally extending members so as to divide said cavity into two compartments;

(3) a pouch integrally joined to the outer sidewall of one of said longitudinally extending members; and (4) means for suspending said container from a support, said suspension means consisting essentially of one or more cords joined at one end to said longitudinally extending members and, at the opposite end, to one or more hooks for engaging an overhead support;

(5) said cord comprising:

(a) two connecting segments, each of which are separately attached to a longitudinally extending member;

(b) two first rings, each of which are individually attached to a said connecting segment;

(c) two intermediate segments, each of which are attached to a said first ring;

(d) a second ring, said second ring being attached to said intermediate segments at their respective ends, opposite said first ring;

(e) two suspension segments, each of which are attached to said second ring; and (f) a third ring, said third ring being attached to said two suspension segments at their respective ends, opposite said second ring; said third ring being further attached to a hook.

23. A portable article holder consisting essentially of:

(1) a container comprised of two flat longitudinally extending members disposed opposite one another, two oppositely disposed flat terminal sidewalls, and a bottom panel, all joined to one another to form, in combination, a cavity into which articles may be placed; each of said terminal sidewalls including a retractable stiffener, said container being foldable when each said stiffener is retracted;

(2) means for suspending said container from a support, said suspension means consisting essentially of one or more cords joined at one end to said longitudinally extending members and, at the opposite end, to one or more hooks for engaging an overhead support;

(3) said cord comprising:

(a) two connecting segments, each of which are separately attached to a longitudinally extending member;

(b) two first rings, each of which are individually attached to a said connecting segment;

(c) two intermediate segments, each of which are attached to a said first ring;

(d) a second ring, said second ring being attached to said intermediate segments at their respective ends, opposite said first ring;

(e) two suspension segments, each of which are attached to said second ring; and (f) a third ring, said third ring being attached to said two suspension segments at their respective ends, opposite said second ring; said third ring being further attached to a hook; and (4) a storage pouch into which said suspending means, said cord, and said container, once folded, may be inserted.

* * * * *